US005690084A

United States Patent [19]

Gunji et al.

[11] Patent Number: 5,690,084

[45] Date of Patent: Nov. 25, 1997

[54] BREATHER STRUCTURE FOR BLOW-BY GAS IN INTERNAL COMBUSTION ENGINE

[75] Inventors: Tohru Gunji; Atsushi Sawa; Shinji Saitoh, all of Saitama, Japan

[73] Assignee: Honda Giken Kogyo Kabushiki Kaisha, Tokyo, Japan

[21] Appl. No.: 680,262

[22] Filed: Jul. 11, 1996

[30] Foreign Application Priority Data

Aug. 11, 1995 [JP] Japan ..... 7-227161

[51] Int. Cl.[6] ..... F01M 13/04

[52] U.S. Cl. ..... 123/572; 123/573

[58] Field of Search ..... 123/572, 573, 123/574, 41.84

[56] References Cited

U.S. PATENT DOCUMENTS

| | | | |
|---|---|---|---|
| 4,651,704 | 3/1987 | Sekiguchi | 123/572 |
| 5,239,972 | 8/1993 | Takeyama et al. | 123/573 |
| 5,487,371 | 1/1996 | Beckman et al. | 123/572 |
| 5,542,402 | 8/1996 | Lee et al. | 123/573 |

FOREIGN PATENT DOCUMENTS 4-52370 8/1992 Japan .

*Primary Examiner*—Marguerite McMahon

*Attorney, Agent, or Firm*—Birch, Stewart, Kolasch & Birch, LLP

[57] ABSTRACT

A breather structure for a blow-by gas which is capable of reducing the oil content in a blow-by gas as much as possible. A breather structure for the blow-by gas in an internal combustion engine, in which an auxiliary machinery is provided in a crank chamber of the internal combustion engine for centrifugally separating the oil content from a blow-by gas by rotation of a rotor portion, integrated with a crank shaft, of the auxiliary machinery. A breather passage for introducing the blow-by gas from which the oil content is separated to the outside of a crank chamber is formed in an auxiliary machinery cover for covering side portions of the auxiliary machinery. In this structure, a cylindrical wall having a center axis identical to the rotational center axis of the rotor portion of the auxiliary machinery is formed in such a manner so as to project from the auxiliary machinery cover to the rotor portion. Also, an outlet is in communication with the breather passage and is formed in a base portion of the cylindrical wall. Additionally, a discharge port opened inwardly of the cylindrical wall in the rotational direction of the rotor portion of the auxiliary machinery is provided for communicating the inside with the outside of the cylindrical wall. The discharge port is formed in the cylindrical wall.

20 Claims, 11 Drawing Sheets

Fig. 7
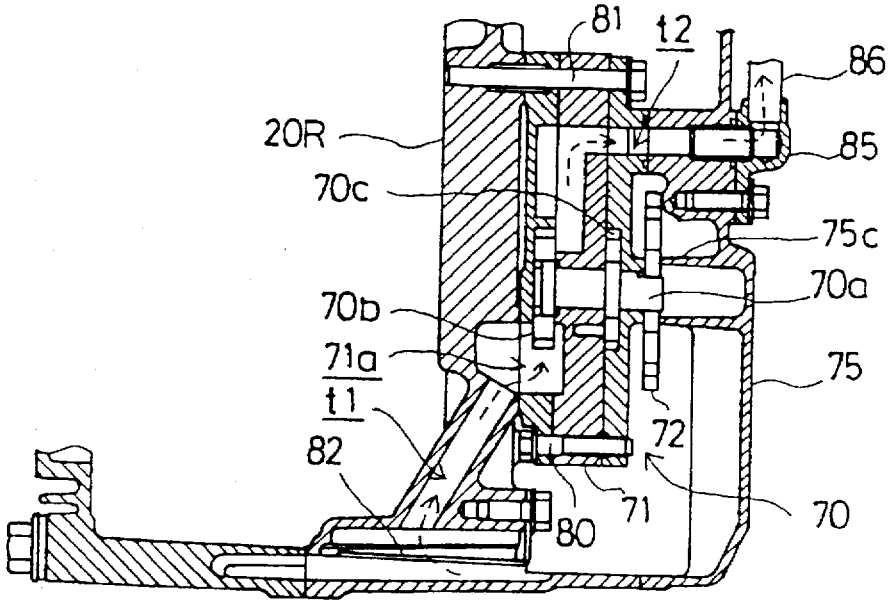
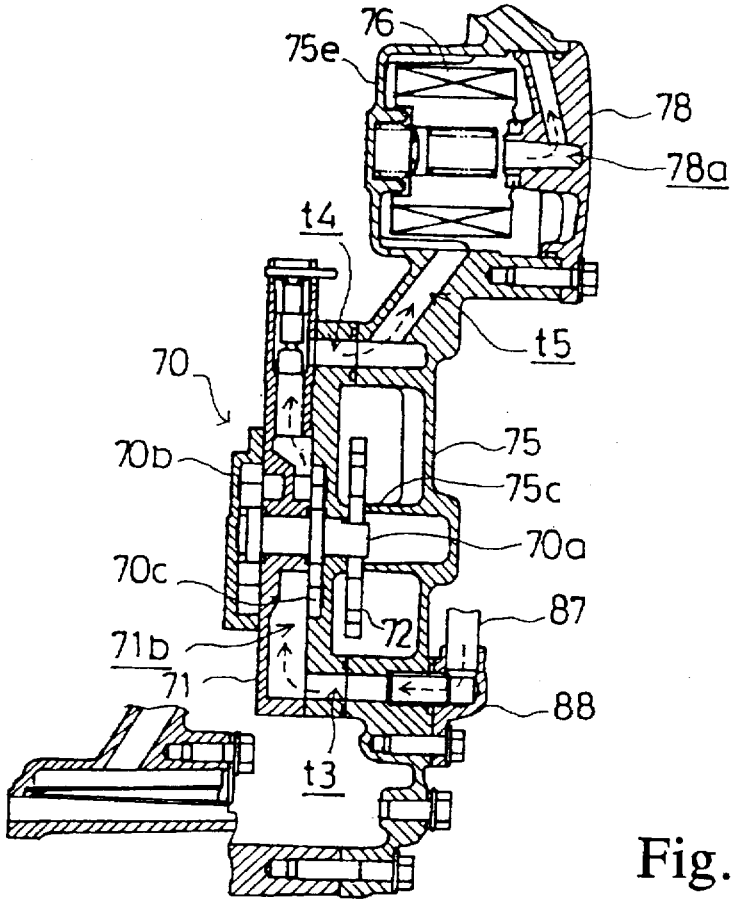
Fig. 8

BREATHER STRUCTURE FOR BLOW-BY GAS IN INTERNAL COMBUSTION ENGINE

BACKGROUND OF THE INVENTION

1. Field of the Invention

The present invention relates to a breather structure for reducing the oil content in a blow-by gas that leaks into the crank case through a gap between a piston and a cylinder in an internal combustion engine.

2. Description of Background Art

It has been proposed that the oil content may be centrifugally separated from a blow-by gas in a crank case by entraining the blow-by gas in a turning flow generated by rotation of a rotor portion of an AC generator rotated integrally with a crank shaft. In this proposal, the blow-by gas remaining at the center is introduced to the outside through a breather passage formed in an ACG cover.

In Japanese Patent Publication No. Hei 4-52370 as illustrated in FIG. 13 of the drawings an AC generator 03 is provided at the end portion of a crank shaft 02 in a crank case 01, and the side portions of the AC generator 03 are covered with an ACG cover 06.

The AC generator 03 is so constructed that an outer rotor 05 mounted on a crank shaft 02 is rotated with respect to an inner stator 04. A gas-liquid mixture of a blow-by gas and lubricating oil flows from a crank chamber into the ACG cover 06 containing the AC generator 03.

A cylinder wall 07, which covers the outer periphery of the leading end portion of the crank shaft 02, is formed at the center of the inner surface of the ACG cover 06. An outlet 08 is formed in the base portion of the cylindrical wall 07. A breather passage 09 extending from the outlet 08 is formed in the ACG cover 06.

With this structure, when the outer rotor 05 is rotated integrally with the crank shaft 02, a turning flow is generated in the ACG cover 06 in which a gas-liquid mixture of the blow-by gas and the oil is present. As a result, the oil content is blown away to the peripheral portion by a centrifugal force and the blow-by gas remains at the center. The blow-by gas from which the oil content is separated is introduced from the outlet 08 into the breather passage 09, to be thus discharged to the outside of the crank chamber.

The blow-by gas, most of which is an unburned gas component, is not discharged to the exterior of the internal combustion engine but is introduced to an air cleaner and finally returned into a combustion chamber.

The blow-by gas, from which the oil content is centrifugally separated by rotation of the outer rotor 05, remains at the center and is then introduced from the outlet 08 into the breather passage 09 through the interior of the cylindrical wall 07. In this case, however, the oil content is not wholly blown away to the peripheral portion by centrifugal separation but partially remains in the cylindrical wall 07. The oil adhesively resides on the inner peripheral surface of the cylindrical wall 07 by the turning flow generated by rotation of the leading end portion of the crank shaft 02 in the cylindrical wall 07.

The usual residence of the oil on the inner peripheral surface of the cylindrical wall 07 allows the oil to be easily sucked into the outlet 08 by the effect of the blow-by gas passing through the interior of the cylindrical wall 07. This obstructs the aim of reducing the oil content in the blow-by gas.

SUMMARY AND OBJECTS OF THE INVENTION

In view of the foregoing, the present invention has been made, and an object of the present invention is to provide a breather passage for a blow-by gas which is capable of reducing the oil content in a blow-by gas as much as possible.

To achieve the above object, according to a preferred mode of the present invention, there is provided a breather structure for a blow-by gas in an internal combustion engine, wherein an auxiliary machinery is provided in a crank chamber of the internal combustion engine centrifugally which separates the oil content from a blow-by gas by rotation of a rotor portion, integrated with a crank shaft, of the auxiliary machinery, and a breather passage for introducing the blow-by gas from which the oil content is separated to the outside of a crank chamber is formed in an auxiliary machinery cover for covering side portions of the auxiliary machinery, wherein a cylindrical wall having a center axis identical to the rotational center axis of the rotor portion of the auxiliary machinery projects from the auxiliary machinery cover to the rotor portion. An outlet communicated to the breather passage is formed in a base portion of the cylindrical wall. A discharge port opened inwardly of the cylindrical wall in the rotational direction of the rotor portion of the auxiliary machinery for communicating from the inside to the outside of the cylindrical wall is formed in the cylindrical wall.

Oil adhering on the inner peripheral surface of the cylindrical wall is moved in the rotational direction of the rotor portion by a turning flow generated in the cylindrical wall, and is discharged to the outside of the cylindrical wall through a discharge port which is formed in the cylindrical wall in such a manner as to be opened inward of the cylindrical wall in the rotational direction of the rotor portion for communicating from the inside to the outside of the cylindrical wall, so that the oil adhering on the inner peripheral surface of the cylindrical wall is speedily discharged without residue. This prevents the oil from being sucked into the outlet by the effect of the blow-by gas passing through the interior of the cylindrical wall, and hence reduces the oil content in the blow-by gas.

The above auxiliary machinery may be an AC generator, and the above cylindrical wall, outlet, and discharge port may be formed on and in an ACG cover. This is advantageous to desirably reduce the oil content in the blow-by gas.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 7 is a sectional view of an oil pump showing an oil passage on a scavenging side;

FIG. 8 is a sectional view of an oil pump and oil filter showing an oil passage on the feed side;

DETAILED DESCRIPTION OF THE PREFERRED EMBODIMENTS

Hereinafter, one embodiment of the present invention will be described with reference to FIGS. 1 to 12.

Figure 1:
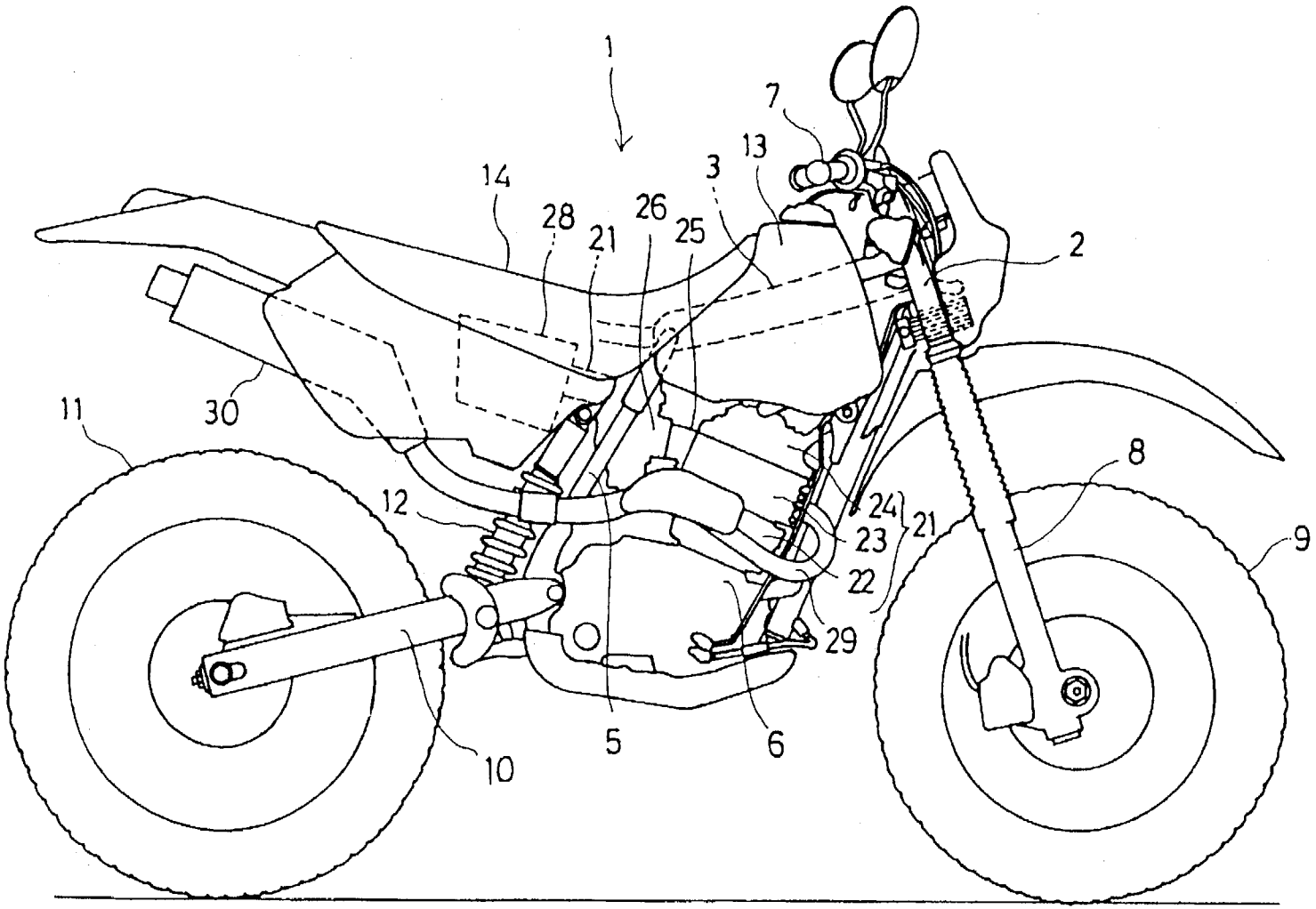
FIG. 1 is a side view of one embodiment of a motorcycle of the present invention.

FIG. 1 is a side view of a motorcycle 1 according to this embodiment. The motorcycle 1 is of an on/off road type. A main pipe 3 extends rearwardly from a head pipe 2, and a down tube 4 extends downwardly from the head pipe 2. The main pipe 3 is divided into a center frame 5 extending downwardly from the rear portion of the main pipe 3 and a seat rail extends rearwardly from the rear portion of the main pipe 3. An internal combustion engine 6 is suspended between the down tube 4 and the center tube 5. Both the main pipe 3 and the down tube 4 contain oil tanks for storing oil.

A handle 7 is rotatably supported by the head pipe 2 and extends upwardly from the head pipe 2 and projects right and left. A front fork 8 is turnably rotated by the handle 7 which extends downwardly, and a front wheel 9 is rotatably supported by the leading end of the front fork 8.

A rear fork 10 is provided rockably in the vertical direction with the front end thereof pivotally supported by the lower end portion of the center frame 5, and a rear wheel 11 is rotatably supported by the rear end of the rear fork 10. A rear cushion 12 is interposed between the rear fork 10 and a body frame.

A fuel tank 13 is disposed in back of the head pipe 2 and over the internal combustion engine 6, and a seat 14 is disposed in back of the fuel tank 13.

The internal combustion engine 6 is of an OHC engine of a single cylinder/four cycle type. A cylinder 21 projects obliquely, forward from a crank case 20. The cylinder 21 includes a cylinder block 22, a cylinder head 23 and a head cover 24. A carburetor 26 is provided continuously to an intake pipe 25 extending rearwardly from the cylinder head 23, and an air cleaner 28 is disposed in back of the carburetor 26 through a connecting pipe 27.

An exhaust pipe 29 extends forwardly from the cylinder head 23 and bypasses the right side of the cylinder 21. The exhaust pipe 29 extends rearwardly therefrom, and is connected to a muffler 30.

Hereinafter, the internal combustion engine 6 will be described with reference to FIGS. 2 to 12. The crank case 20 is divided at the center into a left case 20L and a right case 20R. A crank shaft 33 is contained in the crank case 20 in such a manner as to extend horizontally in the lateral direction. A transmission 34 is also contained in the crank case 20 at a position located in back of the crank shaft 33.

The transmission 34 has a pair of fore and aft shafts horizontally extending in the lateral direction, that is, a main shaft 35 and a counter shaft 36. Gear groups 37, 38 respectively mounted on the main shaft 35 and the counter shaft 36 mesh with each other.

The main shaft 35 and the counter shaft 36 respectively contain oil passages 35*a* and 36*a*, and are each formed with splines at specified positions on the outer peripheries.

Figure 4:
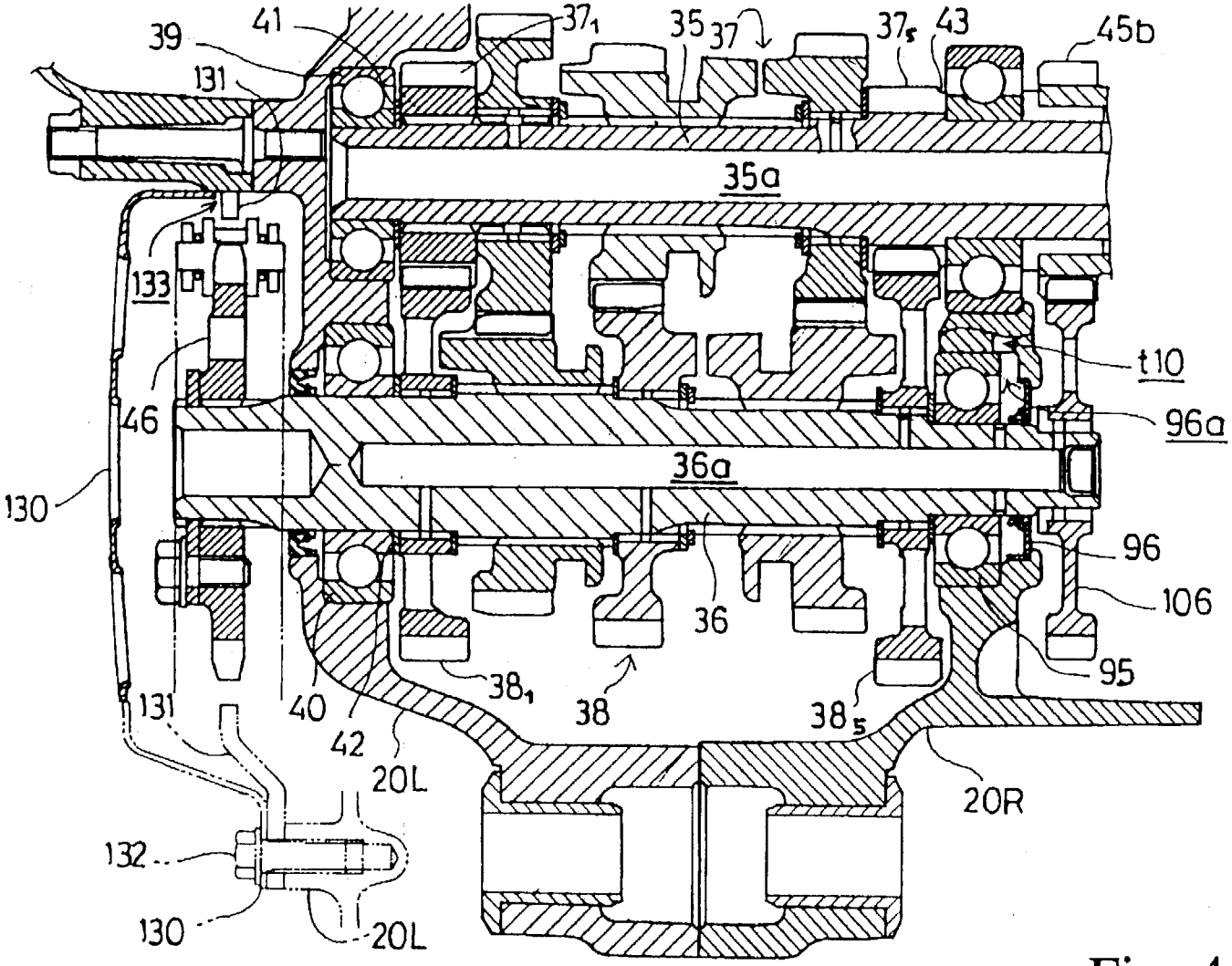
FIG. 4 is an enlarged view of mission gears and their neighborhoods.

Referring to FIG. 4, the mission gears are assembled to the case as follows. Bearings 39, 40 are fitted in two circular recessed portions and formed in the inner surface specified positions of the left case 20L. The gear groups 37, 38 are respectively fitted with the main shaft 35 and the counter shaft 36 in a specified order. Washers 41, 42 are respectively interposed between gears $37_1$, $38_1$ positioned at the left ends of the gear groups 37, 38 and the bearings 39, 40. The main shaft 35 and the counter shaft 40 are respectively inserted in inner races of the bearings 39, 40 and the corresponding gears are in meshing engagement with each other.

The washers 41, 42 ensure clearances between the bearings 39, 40 and the gears $37_1$, $38_1$ positioned at the left ends, and act for axial positioning of the main shaft 35 and the counter shaft 36.

When the washer 41 is left not to be assembled, the axial position of the main shaft 35 is shifted, and thereby the position of a gear $37_5$ which is the frontmost (rightmost) one of the gear group 37 is also axially shifted.

When the washer 42 is left not to be assembled, the position of a gear $38_5$ which is the frontmost (rightmost) one of the gear group 38 is, similarly, axially shifted.

In this embodiment, the right end of the teeth of the rightmost gear $37_5$, which is intended to be assembled to the crank case 20 at the last of the gear group 37, is cutout to such a degree as to exert an effect on the strength of the teeth, to form a stepped portion 43, so that when the washers are assembled, the right side surface of the teeth of the gear $38_5$ meshing with the gear $37_5$ is in the same plane as that of the right stepped portion 43 of the teeth of the gear $37_5$. The thickness of the washer 41 is also set to be different from that of the washer 42.

With this structure, when at least one of the washers 41, 42 is not assembled, a step is generated between the stepped portion 43 of the rightmost gear $37_5$ and the side surface of the gear $38_5$ meshing with the gear $37_5$, and thereby it can be confirmed after assembly of the mission gears that the washer is left not to be assembled. On the other hand, when the washer is certainly assembled, no step is generated therebetween and thereby it can be confirmed after assembly of the mission gears that the assembly is perfectly performed.

While the gear $37_5$ is integrally formed on the main shaft 35 in this embodiment, it may be fitted with the main shaft 35 at a specified position.

A clutch 45 is provided at the right end of the main shaft 35 fitted with the mission gears, and a drive sprocket 46 for transmitting power to the rear wheel 11 is provided at the left end of the counter shaft 36.

On the other hand, a piston 51 is slid in a cylinder liner 50 of the cylinder block 22 in the cylinder 21 projecting from the crank case 20. A piston pin 52 of the piston 51 is connected to a crank pin 53 of the crank shaft 33 by means of a connecting rod 54.

Figure 2:
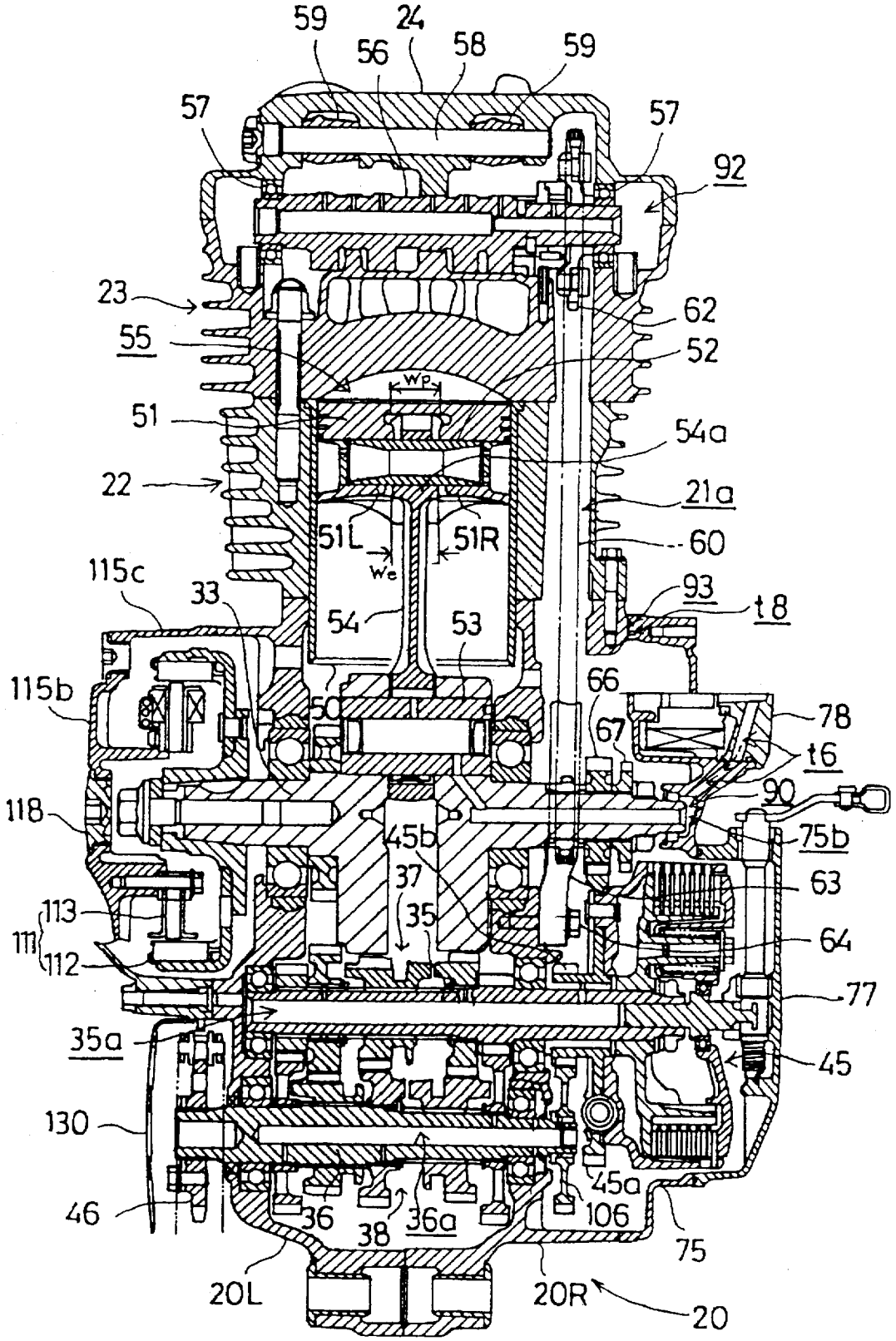
FIG. 2 is a sectional view of an internal combustion engine according to the embodiment.

Referring to FIG. 2, a small end portion of the connecting rod 54 fitted with the piston pin 52 is formed into a tapered shape with its width gradually being made narrower from the base portion to the leading end. The minimum width Wp of an interval between right and left bearings 51R, 51L for supporting both the ends of the piston pin 52 is set to be larger than a width We of the base portion of the small end portion 54*a* of the connecting rod 54. This improves the comformability of the small end portion 54*a* to the bearing portions 51R, 51L by preventing interference therebetween, and thereby makes smooth the connecting drive of the piston 51 and the connecting rod 54.

The cylinder head 23 continuous to the cylinder block 22 forms on the lower surface side a combustion chamber 55 positioned over the cylinder liner 50, and it has on the upper portion bearings for a cam shaft 56. The bearings and bearings on the head cover 24 side hold the cam shaft 56 from the upper and lower sides. Both end portions of the cam shaft 56 are rotatably supported by bearings 57.

A pair of fore and aft rocker shafts 58 are provided in the head cover 24, and rocking ends of rocker arms 59, rotatably supported by each of the rocker shafts 58, are slidably contacted with a cam peripheral surface of the cam shaft 56.

A cam chain 60 is used for transmitting power from the crank shaft 33 to the cam shaft 56 which is remote from the crank shaft 33 while putting the cylinder 21 therebetween. The cam chain 60 is inserted in a chain path 21*a* formed in a cylinder side wall and is hung between a sprocket 61 of the crank shaft 33 and a sprocket 62 of the cam shaft 56.

Figure 3:
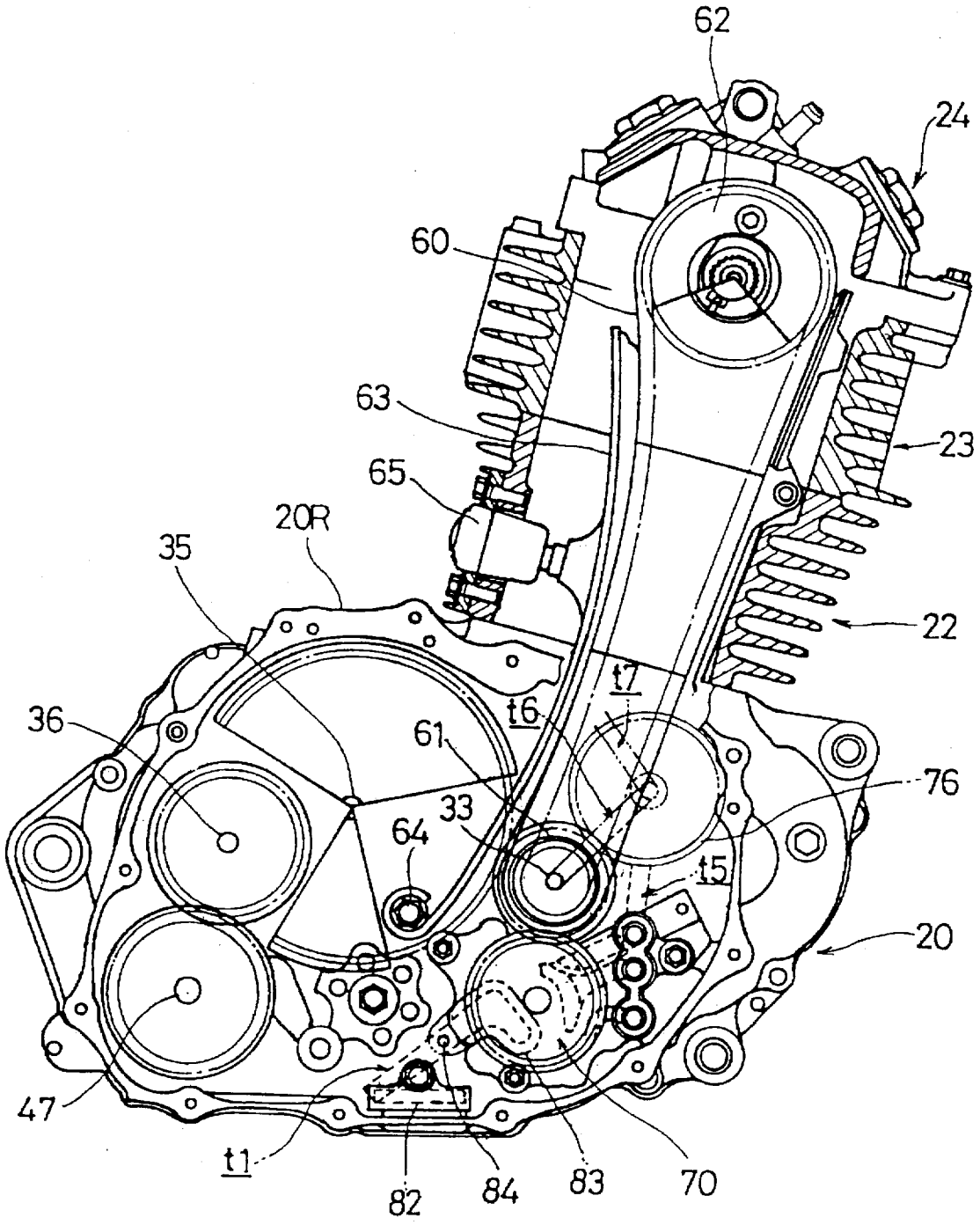
FIG. 3 is a side view of the internal combustion engine showing a state in which a right cover is removed, parts being partially cutaway.

The rear side of the cam chain 60 is hung between the sprockets 61, 62 substantially in the vertical direction and is suitably pressed by a vertically long-sized arched cam chain slider 63, to give a tension to the cam chain 60 (see FIG. 3).

The vertically long-sized cam chain slider 63 extends downward up to the lower portion of the clutch 45, and the lower end thereof is pivotally supported by a pivot 64 so as to be rockable fore and aft. The center of the cam chain slider 63 is biased forward by a cam chain tentioner 65 provided on the cylinder block 22 for giving a tension to the cam chain 60.

The slider surface of the cam chain slider 63 is positioned directly behind the cam chain 60; however, a portion 63*a*, pivotally supported by the pivot 64, of the lower end of the cam chain slider 63 is offset leftward for preventing interference with the clutch 45 positioned on the right side (see FIG. 2).

Figure 6:
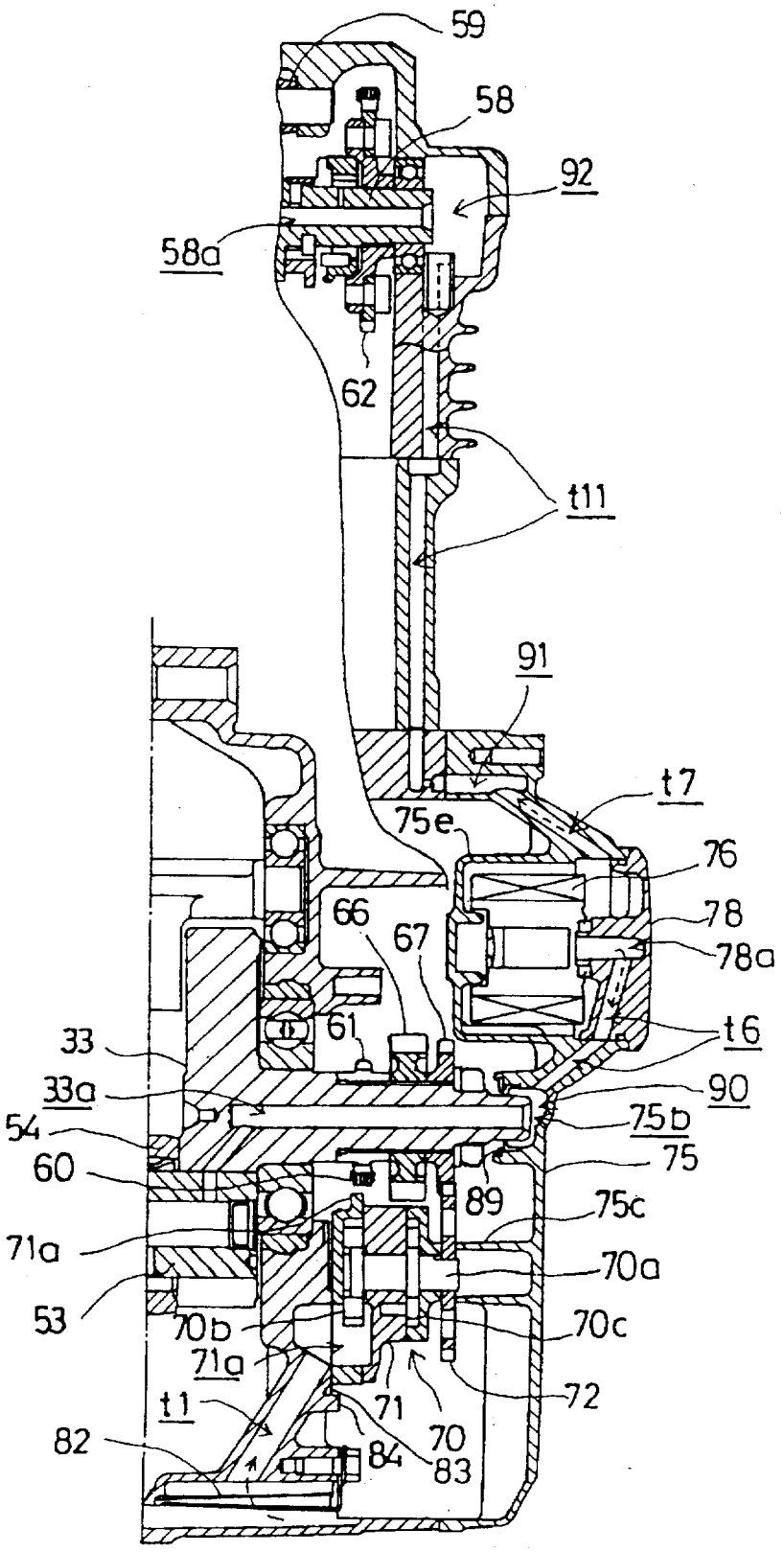
FIG. 6 is a sectional view of a right crank case and a right cylinder.

An oil pump 70 is disposed under the lower sprocket 61 around which the cam chain 60 is hung. As shown in FIG. 6, a chain slip-off preventive guide 71*a* projects upwardly from an oil pump case 71 so as to be positioned adjacent to, from bottom to top, the cam chain 60 hung around the sprocket 61.

Accordingly, even when the cam chain 60 is removed from the upper sprocket 62 upon maintenance for the upper portion of the cylinder, the lower portion of the cam chain 60 is not easily removed from the lower sprocket 61 by the presence of the chain slip-off preventive guide 71*a* which is close to the lower sprocket 61. This allows the cam chain 60 to be effectively hung around the sprocket 62 again without any laborious work because the lower portion of the cam chain 60 is left hung around the lower sprocket 61.

A clutch drive gear 66 is fitted around the crank shaft 33 on the right side of the sprocket 61, and an oil pump drive gear 67 is also fitted around the crank shaft 33 on the right side of the clutch drive gear 66. The clutch drive gear 66 meshes with a clutch driven gear 45*a* provided around the clutch outer (see FIG. 2), and the oil pump drive gear 67 meshes with an oil pump driven gear 72 fitted around a pump drive shaft 70*a* to drive an oil pump 70 (see FIG. 6).

Figure 5:
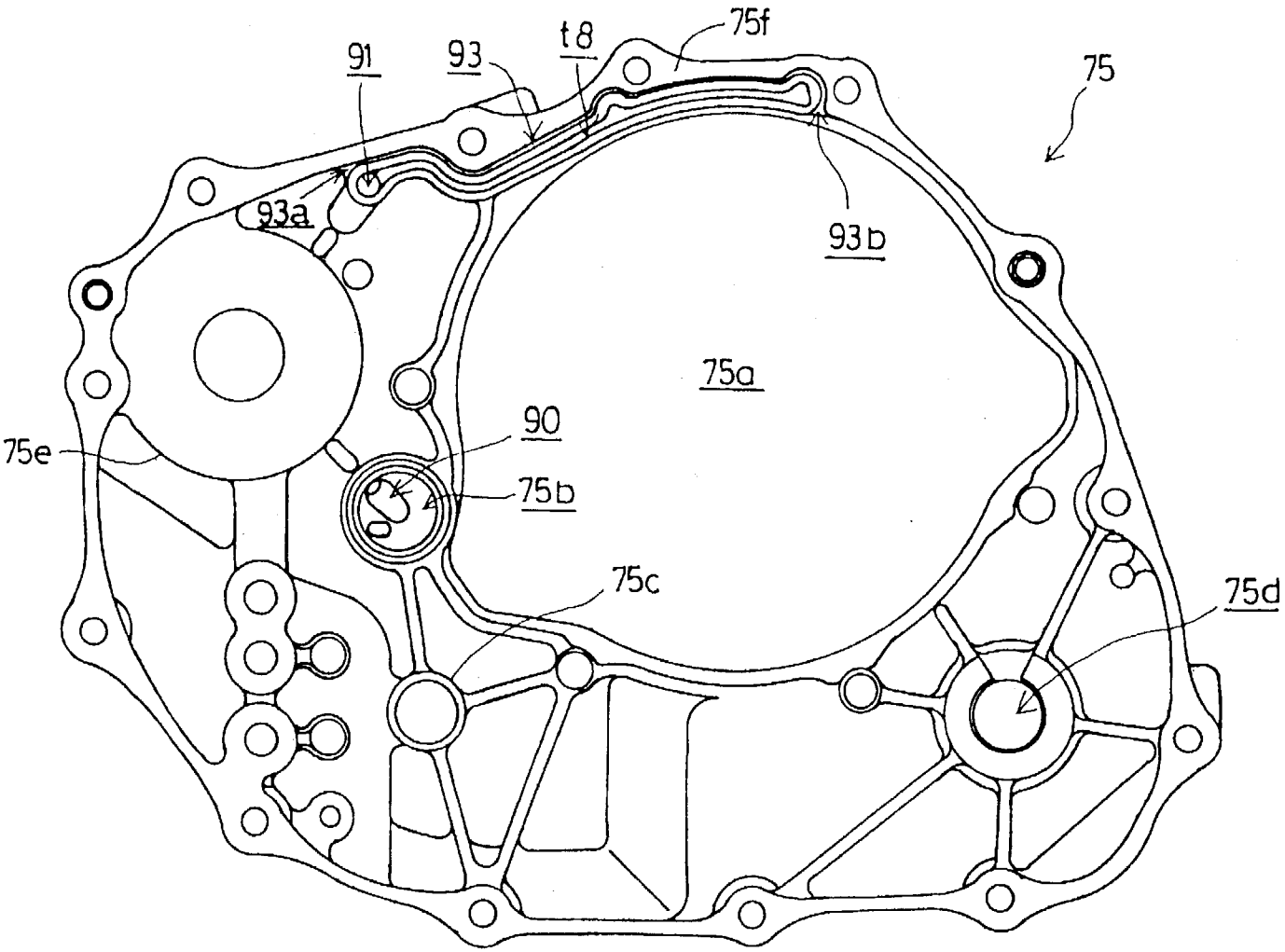
FIG. 5 is a view showing the inner surface of the right cover.

The right side of the right case 20R of the crank case 20 is covered with a right cover 75. As shown in FIG. 5, the inner surface of the right cover 75 is formed with a large opening 75*a* at a position corresponding to the clutch 45; a recessed portion 75*b* corresponding to the crank shaft 33; an inward projecting cylinder portion 75*c* with a bottom corresponding to the pump drive shaft 70*a* of the oil pump 70; and a circular hole 75*d* for passing the right end of a kick shaft 47 positioned under the counter shaft 36 therethrough and supporting the counter shaft 36. Moreover, a filter case 75*c* for an oil filter 76 is formed on the front portion of the right cover 75 in such a manner as to be enlarged inwardly in a cylindrical shape.

The opening 75*a* corresponding to the clutch 45 is covered with a clutch cover 77, and the opening of the filter case 75*e* is blocked with a filter lid member 78.

The oil pump 70 includes a scavenging side rotor 70*b* and a feed side rotor 70*c* which are rotatably provided around the pump drive shaft 70*a* fitted with the oil pump drive gear 67 in such a manner as to be rotatable in the oil case 71.

As shown in FIG. 7, the oil case 71 is divided into three parts right and left which are integrally connected to each other by means of a bolt 80. The three parts of the oil case 71 are held between the right case 20R of the crank case 20 and the right cover 75 and are integrally fastened to the right case 20R by means of a bolt 81.

As shown in FIGS. 6 and 7, engine oil remaining on the bottom portion of the crank case 20 flows through a strainer 82, passing through an oil passage t1 formed in the right case 20R, and enters the oil case 71 from a scavenging port 71*a*.

A metal gasket 83 is held, at a position around the scavenging port 71*a*, between the mating faces of the right case 20R and the oil case 71 (shown by a two-dot chain line in FIG. 3).

Figure 9:
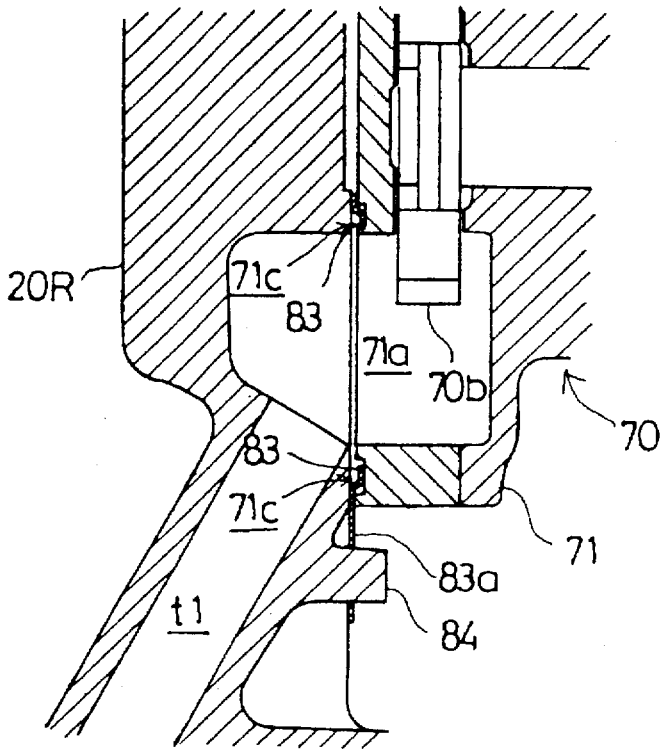
FIG. 9 is an enlarged view showing an essential portion of FIG. 6.

A recessed portion 71*c* is annularly formed around the scavenging port 71*a* of the oil case 71 as shown in FIG. 9, and the metal gasket 83 is bent and fitted in the recessed portion 71*c* for preventing oil leakage.

The seal structure by the metal gasket 83 can sufficiently prevent oil leakage even when the fastening of the oil case 71 to the right case 2OR by means of the bolt 81 is set to not be strong but to be suitably loose. Thereby, deformation of the oil pump case 71 due to a strong fastening, which exerts an effect on the oil pump shaft 70*a*, can be prevented.

The metal gasket 83 protrudes from the mating faces of the right case 2OR and the oil case 71 as shown in FIG. 9, and a circular hole is formed in the protruding portion 83*a*. A gasket positioning pin 84 projects from a cylindrical portion constituting the oil passage t1 and is inserted in the circular hole. The positioning of the metal gasket 83 upon assembly is performed by the fitting of the gasket positioning pin 84 within the circular hole.

As shown in FIG. 7, oil sucked in the scavenging port 71*a* is press-fed into an oil passage t2 by rotation of the scavenging side rotor 70*b*, passing through an oil pipe 86, outside the internal combustion engine 6, connected to a connecting member 85 mounted on the right cover 75, and is introduced to the oil tank formed in the main pipe 3 and the down tube 4.

The oil in the oil tank flows from the oil pipe 87 into an oil passage t3 by way of a connecting member 88 as shown in FIG. 8, and reaches the feed port 71*b* of the oil pump 70.

The oil is then press-fed into an oil passage t4 by rotation of the feed side rotor 70*c*, and fed into the filter case 75*e* by way of an oil passage t5 communicated to the oil filter 76 positioned obliquely, upwardly from the oil pump 70. The oil runs from the outer periphery to the inner periphery of the cylindrical oil filter 76, and reaches a discharge port 78*a* provided in the filter lid member 78.

The oil reaching the discharge port 78*a* is branched into an oil passage t6 directed downwardly and an oil passage t7 directed upwardly, as shown in FIG. 6.

The oil passage t6 extending downwardly is connected to an oil passage t6 of the right cover 75, and is communicated to the recessed portion 75*b* in the inner surface of the right cover 75 into which the right end of the crank shaft 33 is inserted through an oil seal 89.

The oil passage t6 is obliquely communicated to the recessed portion 75*b*. The portion, near the outlet, of the recessed portion 75*b* is enlarged to form an enlarged portion 90. Thus, the oil introduced by the oil passage t6 can obliquely flow in the recessed portion 75*b* smoothly by the presence of the enlarged portion 90.

The oil flows from the recessed portion 75*b* into an internal oil passage 33*a* of the crank shaft 33, being introduced by the crank pin 53, and is supplied to a sliding portion with the connecting rod 54.

On the other hand, the oil flowing in the oil passage t7 extending upwardly from the discharge port 78*a* of the oil filter 76 is divided at a branching portion 91 midway into an oil passage t8 formed in the right cover 75 along the mating face with the right case 20R of the crank case 20 (see FIG. 5), and an oil passage t11 extending upward along the outer wall of the cylinder 21 and reaching an oil chamber 92 composed of the cylinder head 23 and the head cover 24.

The oil entering the oil chamber 92 flows in an internal oil passage 56*a* of the cam shaft 56, to be supplied to an sliding portion such as the rocker arm 59 and the like.

The oil passage t8 extends rearwardly along a mating face 75*f* on the upper wall of the right cover 75 as shown in FIG. 5, and in the midway, an oil passage t9 is opened at the mating face on the right case 2OR side. An oil passage t10 is continuous to the rear end of the oil passage t8 and is opened at the mating face on the right case 2OR side (see FIG. 3).

An escape groove 93 is formed so as to extend along the outside of the oil passage tB extending in the longitudinal direction, as shown in FIG. 5. The front end of the escape groove 93 has an opening 93*a* inclined slightly downwardly and forwardly, and the rear end of the escape groove 93 has an opening 93*b* inclined downwardly so as to bypass the rear end of the oil passage t8. Either of the openings 93*a* and 93*b* is opened inward of the crank case.

The oil intended to be leaked from the oil passage t8 to the outside is thus entrapped by the escape groove 93 formed outside the oil passage t8 and returned from the forward and rear openings 93*a*, 93*b* into the crank case 20, to thereby prevent the oil leakage from the crank case to the outside.

The escape groove 93 can be deepened so as to ensure sufficient cross-section, thereby preventing oil leakage from the crank case to the outside.

The oil flowing in the oil passage t9 reaches the internal oil passage 35*a* of the main shaft 35, to be supplied to sliding portions with the gear group 37.

Referring to FIG. 4, a bearing 95 rotatably supporting the counter shaft 36 is fitted in and supported by the inner wall of the right case 20R, and the oil passage t1O extends to the inner wall. An opening is provided along the outer race side surface of the bearing 95.

An oil seal 96 formed in a thin and cylindrical shape with the center inserted in the counter shaft 36 is provided on the outer race side surface of the bearing 95, and a cutout 96*a* is formed in part of the outer periphery press-in wall of the oil seal 96. The cutout 96*a* is matched with the opening of the oil passage t1O, and allows the oil flowing in the oil passage t1O to easily flow in the internal oil passage 36*a* of the counter shaft 36.

The oil flowing in the internal oil passage 36*a* of the counter shaft 36 is supplied to sliding portions with the gear group 38.

Figure 10:
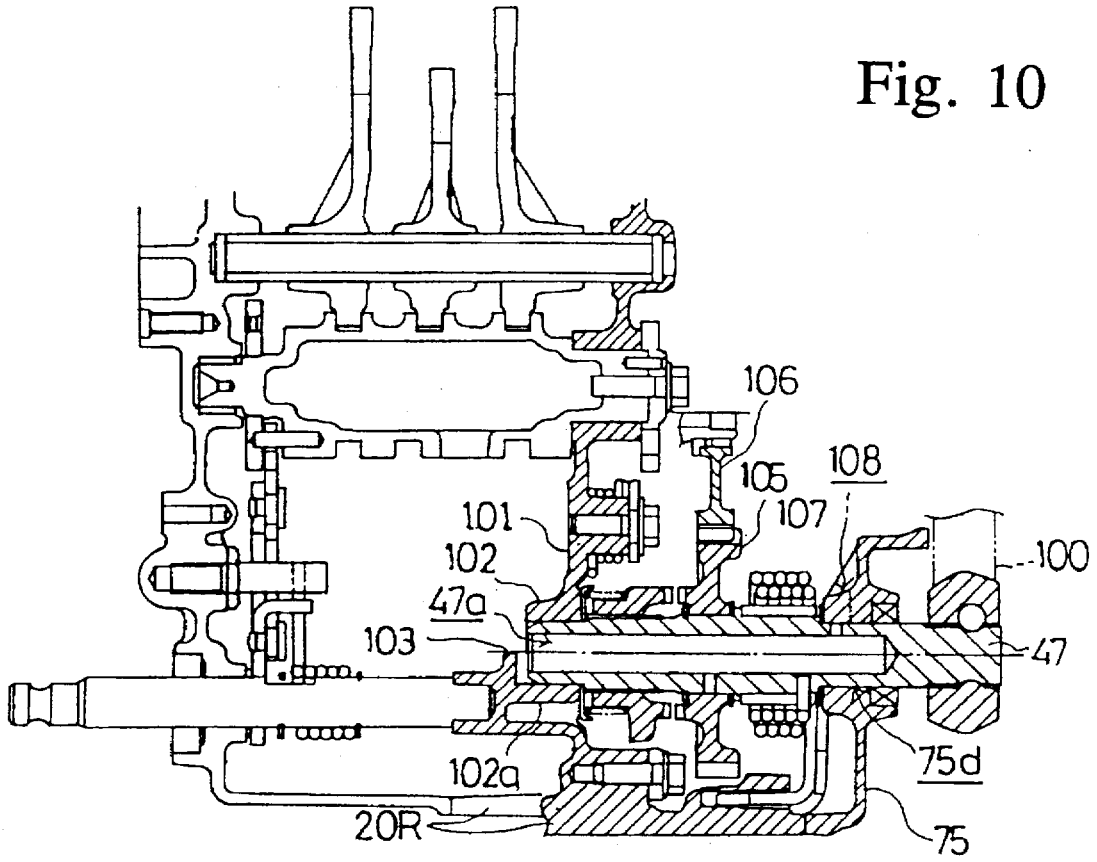
FIG. 10 is a sectional view of the neighborhood of a kick shaft of the lower portion of a crank case.

The kick shaft 47 is positioned under the counter shaft 36. As shown in FIG. 10, the right end of the kick shaft 47 passes through the circular hole 75*d* of the right cover 75 and projects outwardly to be fitted with a kick arm 100, while the left end of the kick shaft 47 is rotatably supported by a bearing portion 102 formed on an inner wall 101 of the right case 2OR of the crank case 20.

A lower semi-cylindrical portion 102*a* of the bearing portion 102 extends slightly inwardly, and the semicircular end thereof is blocked with a semi-circular weir wall 103 to form an oil sump in the lower semi-cylindrical portion 102*a*.

An oil passage 47*a* is formed in the kick shaft 47, and the height of the weir wall 103 corresponds to the center axis of the columnar oil passage 47*a*. Accordingly, the oil remaining by the weir wall 103 can fill the lower half of the oil passage 47*a*, to thereby usually keep oil in the oil passage 47*a* of the kick shaft 47.

A kick return spring 107 is wound around the kick shaft 47. A dog-clutch gear 104 spline-connected to the kick shaft 47 is removably provided opposite to the other dog-clutch gear 105 rotatably supported by the kick shaft 47. The dog-clutch gear 105 meshed with a kick idle gear 106 is rotatably supported by the counter shaft 36.

The kick idle gear 106 meshes with a clutch gear 45*b* integrated with the clutch driven gear 45*a* provided on a clutch outer of the clutch 45 provided on the main shaft 35 (see FIG. 2).

Accordingly, when the kick shaft 47 is rotated by the operation of the kick arm 100, the dog-clutch 104 is engaged with the other dog-clutch gear 105, so that a kick starting torque is transmitted to the kick idle gear 106, clutch gear 45*b*, clutch driven gear 45*a*, and clutch drive gear 66 fitted with the crank shaft 33 in this order, to start the engine.

In addition, an oil hole 108 is formed in the upper portion of the inner peripheral edge of the circular hole 75*d* of the right cover 75 rotatably supporting the kick shaft 47, and the oil transmitted along the inner surface of the right cover 75 is introduced from the oil hole 108 to the internal oil passage 47*a* of the kick shaft 47.

An AC generator 111 is provided at the left end of the crank shaft 33, and an ACG cover 115 covers the AC generator 111 from the left side.

Figure 11:
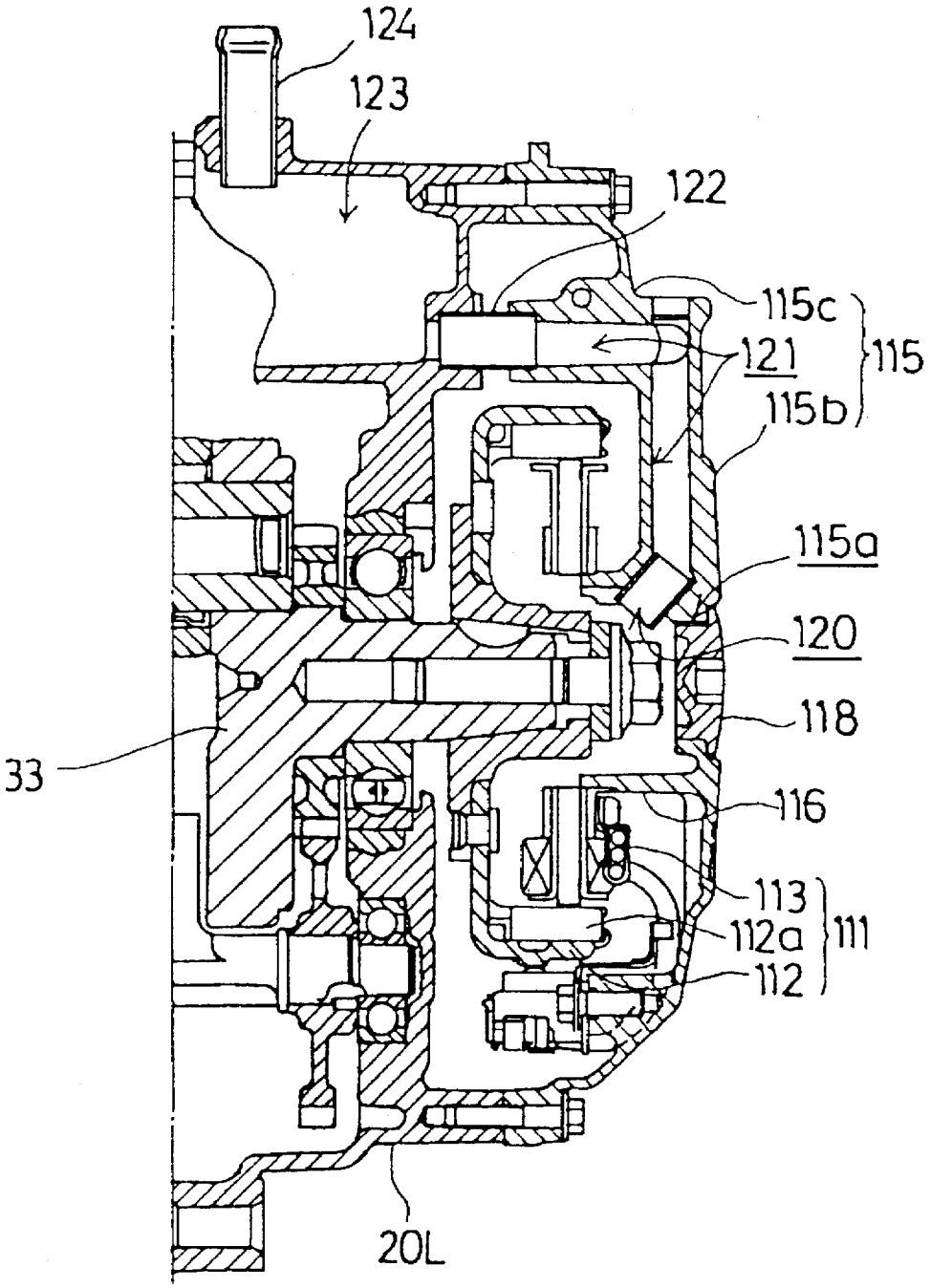
FIG. 11 is a sectional view of a left half of a crank chamber, seen substantially from the front side.
Figure 12:
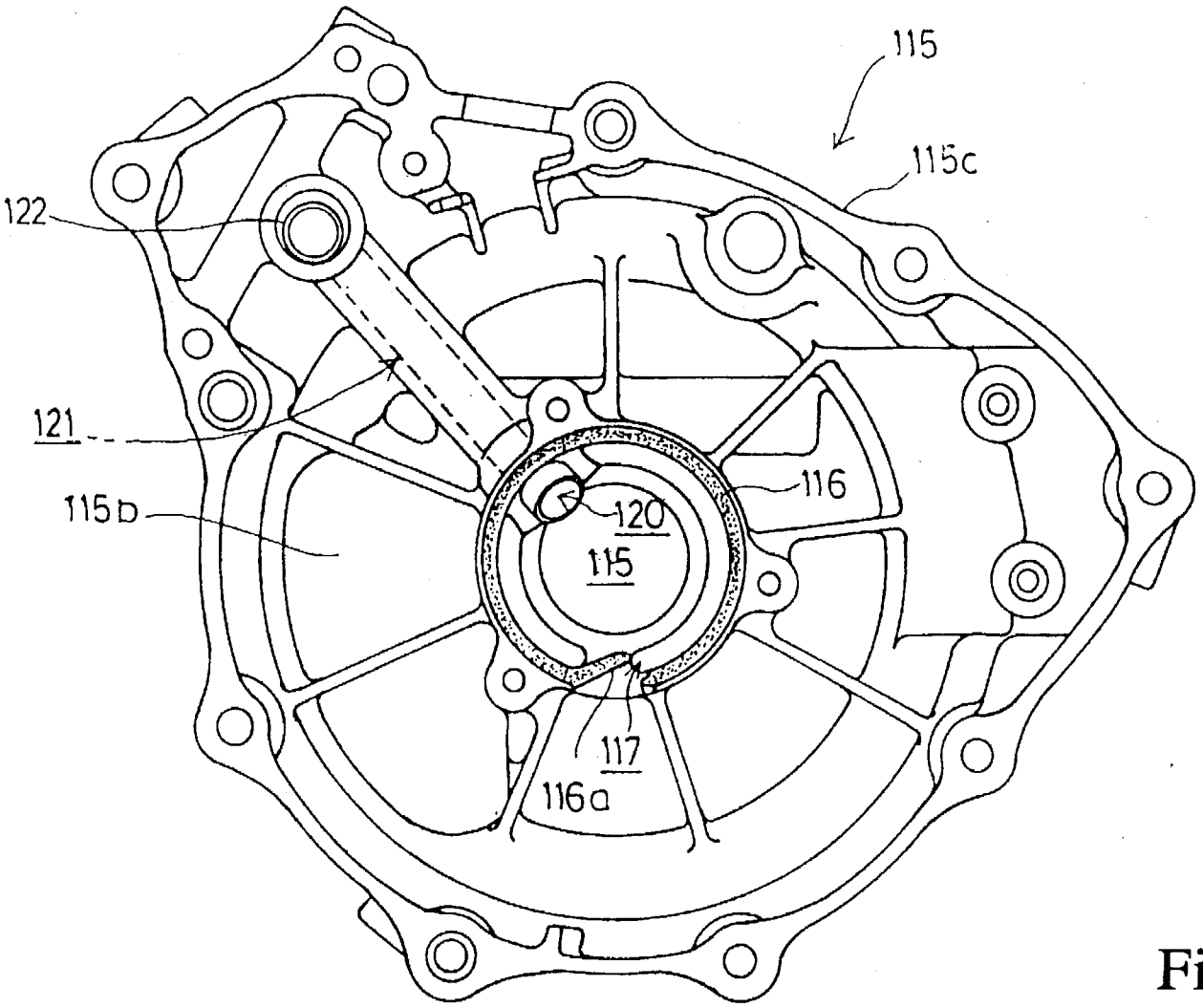
FIG. 12 is a view showing an inner surface of an ACG cover.
Figure 13:
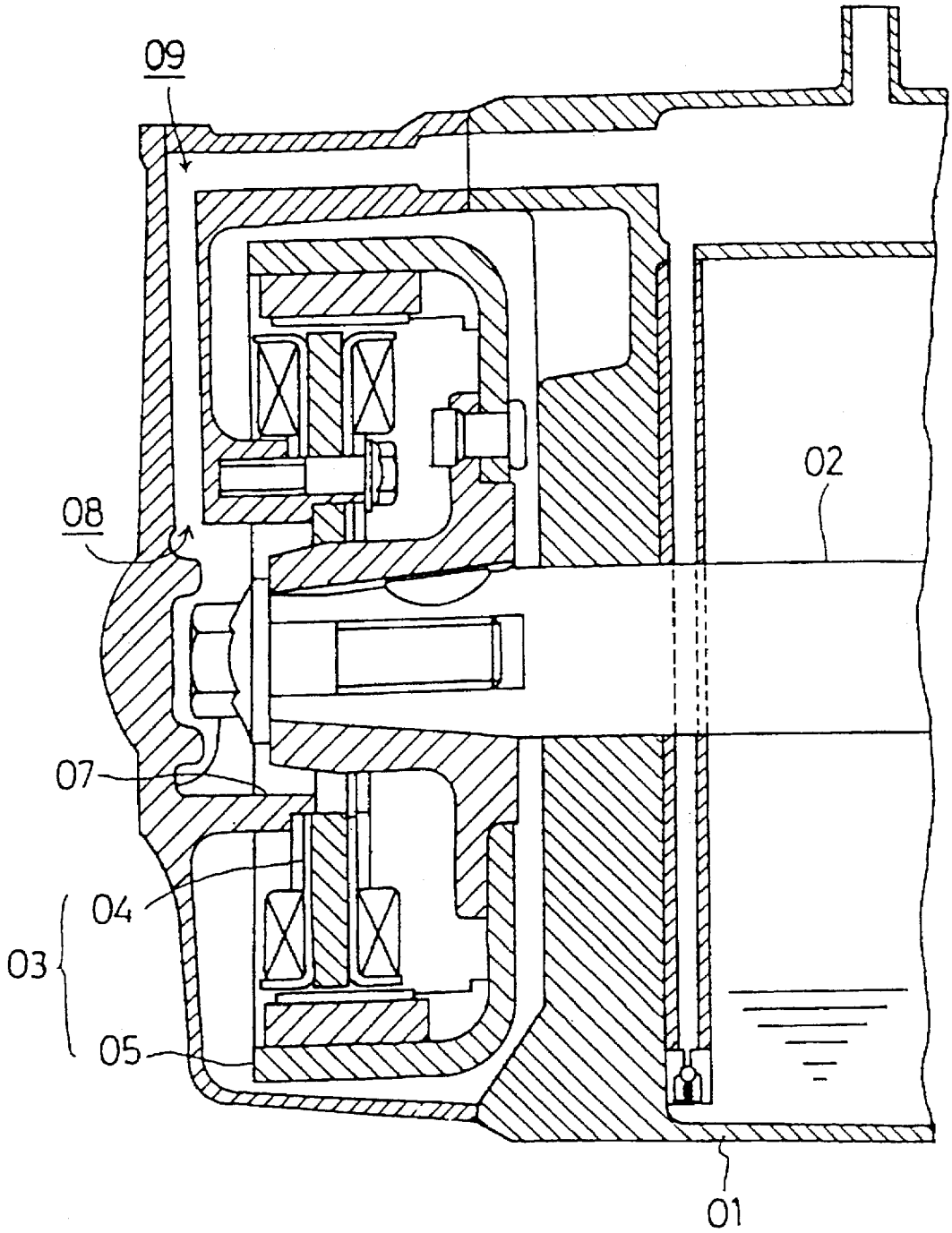
Fig. 13 PRIOR ART
FIG. 13 is a sectional view showing an essential portion of a crank chamber showing a related art blow-by gas breather structure.

FIG. 11 is a sectional view of the left half structure of the crank chamber, substantially seen from the front side. FIG. 12 is a view showing the inner surface of the ACG cover 112. Referring to FIGS. 2, 11 and 12, an outer rotor 112, U-shaped in section and opened leftward (outward), of the AC generator 111 is integrally mounted at the left end of the crank shaft 33, and a magnet 112*a* is fixed on the inner peripheral surface of the rotating outer rotor 112.

The ACG cover 115 includes a bottom portion 115*b*, as a left side wall, having a circular hole 115*a* at the center thereof and a peripheral wall portion 115*c*. A cylindrical wall 116 projects inward from the periphery of the center hole 115*a* of the bottom portion 115*b* in such a manner so as to surround the periphery of the left end portion of the crank shaft 33. An inner stator 113 of the AC generator 111 is fixed on the outer periphery of the cylindrical wall 116 at a position inside the outer rotor 111*a*. In addition, the circular hole 115*a* at the center of the bottom portion 115*b* is blocked with a lid member 118.

The lower side of the cylindrical wall 116 is partially cut, to form a guide piece 116*a* which is bent inward. Namely, as shown in FIG. 12, the cylindrical wall 116 (the peripheral edge surface of the cylindrical wall 116 is shown by dotted points in FIG. 12) extends along the circumference clockwise from the leading end of the guide piece 116*a* taken as a starting point. An oil discharge port 117 opens inwardly and is formed between the tail end of the cylindrical wall 116 and the leading end of the guide piece 116*a*.

The outer rotor 112 of the AC generator 111 rotates integrally with the crank shaft 33 and is also rotated clockwise in FIG. 12. Thereby, the oil discharge port 117 is opened in the rotational direction.

A blow-by gas outlet 120 is provided at the base portion of the cylindrical wall 116, that is, at the position rearwardly, obliquely and upwardly from the bottom portion 115*b* side. A breather passage 121 is formed in the bottom portion 115*b* in such a manner so as to extend in the centrifugal direction from the blow-by gas outlet 120. The breather passage 121 is bent and extends rightwardly substantially in the horizontal direction in the peripheral wall portion 115*c*, and is communicated to a blow-by gas chamber 123 of the left case 20L of the crank case 20 through a communicating pipe 122 (see FIG. 11).

In addition, a connecting pipe 124 is provided in the blow-by gas chamber 123, and a gas pipe having one end connected to the connecting pipe 124 is connected at the other end to the air cleaner 28.

With this structure, the oil content of the blow-by gas present in the crank chamber as a gas-oil mixture is centrifugally separated from the blow-by gas and blown away to the peripheral portion by a turning flow generated by rotation of the outer rotor 112 of the AC generator 111 integrated with the crank shaft 33. The blow-by gas remaining at the center from which the oil content is separated is sucked into the blow-by gas outlet 120 provided at the depth of the cylindrical wall 116, passing through the breather passage 121 and reaching the blow-by gas chamber 123, and is discharged from the crank chamber by the gas pipe, to be supplied to the air cleaner 28.

The oil also adheres on the inner peripheral surface of the center cylindrical wall 116 as a passage of the blow-by gas. However, the oil adhering on the inner peripheral surface of the cylindrical wall 116 is moved clockwise by a turning flow generated by clockwise rotation of the leading end portion of the crank shaft 33 in the cylindrical wall 116 (see FIG. 12), so that the oil can be discharged to the outside from the oil discharge port 117 formed in the lower portion so as to be opened in the rotational direction.

The oil is thus prevented from remaining on the inner peripheral surface of the cylindrical wall 116 and from being sucked from the blow-by gas outlet 120. This makes it possible to reduce the amount of the oil in the discharged blow-by gas.

In addition, the communicating pipe 122 is offset slightly upwardly from the horizontal breather passage 121 so that the bottom surface of the horizontal breather passage 121 is at the same height as that of the bottom surface of the communicating pipe 122 (see FIG. 11).

In some cases, when a blow-by gas passes through the breather passage 121, the oil is slightly cooled and adheres on the inner surface of the breather passage 121. However, since the bottom surface of the horizontal breather passage 121 has the same height as that of the bottom surface of the communicating pipe 122, the oil does not remain on the bottom surface of the breather passage 121 and is mainly returned to the crank chamber.

On the left side surface of the crank case 20, the ACG cover 115 covers the AC generator 111 and a thin plate sprocket cover 130 covers, from the left side, the drive sprocket 46 fitted with the left end of the counter shaft 36.

Referring to FIG. 4, a chain guide 131 is partially disposed around the outer periphery of the drive sprocket 46, and is positioned between three points of the sprocket cover 130 and the left case 20L of the crank case 20. Then, the sprocket cover 130 and the chain guide 131 are fastened at the three points to the left case 20L of the crank case 20 by means of bolts 132.

An interval 133 is formed between the sprocket cover 130 and the chain guide 131, other than the above three fixing portions. In other words, the sprocket cover 130 does not contact with the chain guide 131, other than the above three fixing portions.

The interval 133 is effective to prevent generation of the tapping noise due to vibration between the sprocket cover 130 and the chain guide 131.

According to the present invention, a cylindrical wall having the center axis identical to the rotational center axis of the rotor portion of the auxiliary machinery is formed in such a manner so as to project from the auxiliary machinery cover to the rotor portion. An outlet communicated to the breather passage is formed in a base portion of the cylindrical wall. A discharge port opens inwardly of the cylindrical wall in the rotational direction of the rotor portion of the auxiliary machinery for communicating from the inside to the outside of the cylindrical wall and is formed in the cylindrical wall. As a result, oil adhering on the inner peripheral surface of the cylindrical wall is moved in the rotational direction of the rotor portion by a turning flow in the cylindrical wall and is discharged to the outside through the discharge port of the cylindrical wall. The oil adhering on the inner peripheral surface of the cylindrical wall is thus quickly discharged without residue. This prevents the oil from being sucked in the outlet by the blow-by gas passing through the interior of the cylindrical wall, and hence reduces the oil content in the blow-by gas.

The auxiliary machinery may be an AC generator, and the cylindrical wall, outlet, and discharge port may be formed on and in an ACG cover. This is advantageous to desirably reduce the oil content in the blow-by gas.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A breather structure for a blow-by gas in an internal combustion engine having auxiliary machinery provided in a crank chamber of said internal combustion engine for centrifugally separating oil from the blow-by gas by rotation of a rotor portion, integrated with a crank shaft of said auxiliary machinery, and a breather passage, for introducing the blow-by gas from which the oil content is separated to the outside of the crank chamber, formed in a cover for covering side portions of said auxiliary machinery comprising:

a substantially cylindrical wall having a center axis substantially identical to a rotational center axis of said rotor portion of said auxiliary machinery formed to project from said auxiliary machinery cover to said rotor portion;

an outlet communicating with said breather passage formed in a base portion of said substantially cylindrical wall; and a discharge port in communication inwardly of said substantially cylindrical wall in the rotational direction of said rotor portion of said auxiliary machinery for communicating from the inside to the outside of said substantially cylindrical wall, said discharge port being formed in said substantially cylindrical wall.

2. The breather structure for a blow-by gas in an internal combustion engine according to claim 1, wherein said auxiliary machinery is an AC generator, and said substantially cylindrical wall, said outlet, and said discharge port are formed on and in an AC generator cover.

3. The breather structure for a blow-by gas in an internal combustion engine according to claim 1, wherein said substantially cylindrical wall projects inwardly from said auxiliary machinery cover to provide a substantially circular passageway for blow-by gas to be collected therein for centrifugally separating oil from said blow-by gas.

4. The breather structure for a blow-by gas in an internal combustion engine according to claim 3, wherein oil separated from said blow-by gas is returned to said auxiliary machinery through said discharge port.

5. The breather structure for a blow-by gas in an internal combustion engine according to claim 1, and further including a guide member disposed adjacent to said discharge port for aiding in the discharge of oil from said blow-by gas.

6. The breather structure for a blow-by gas in an internal combustion engine according to claim 1, wherein said outlet communicating with said breather passage is disposed at a point on an outer circumference of said substantially cylindrical wall at a point displaced relative to said discharge port.

7. The breather structure for a blow-by gas in an internal combustion engine according to claim 1, wherein said outlet communicating with said breather passage is in communication with a blow-by gas chamber for receiving blow-by gas with oil removed therefrom prior to discharging said blow-by gas to an air cleaner.

8. The breather structure for a blow-by gas in an internal combustion engine according to claim 1, wherein said substantially cylindrical wall surrounds an end portion of a crank shaft for forming an area for collecting the blow-by gas and subsequently applying a centrifugal force thereto for removing oil therefrom.

9. The breather structure for a blow-by gas in an internal combustion engine according to claim 1, wherein said rotor portion includes an outer rotor for producing a turning flow of the blow-by gas for permitting centrifugal separation of the oil contained therein.

10. The breather structure for a blow-by gas in an internal combustion engine according to claim 1, wherein oil centrifugally separated from said blow-by gas contacts an inner surface of said cylindrical wall and is transported in a clockwise direction by a turning flow generated by a clockwise rotation of a leading end portion of said crank shaft.

11. A breather structure for a blow-by gas in an internal combustion engine comprising:

a crank chamber positioned adjacent to said internal combustion engine;

a crank shaft operatively disposed within said crank chamber;

a rotor portion secured to said crank shaft for producing a turning flow of the blow-by gas for centrifugally separating oil from the blow-by gas by rotation of said rotor;

a breather passage for exhausting the blow-by gas from which the oil content is separated to the outside of the crank chamber;

a substantially cylindrical wall having a center axis substantially identical to a rotational center axis of said rotor portion, said substantially cylindrical wall being formed to project adjacent to said rotor portion with a space being formed therebetween;

an outlet communicating with said breather passage formed in a base portion of said substantially cylindrical wall; and a discharge port in communication inwardly of said substantially cylindrical wall in the rotational direction of said rotor for communicating from the inside to the outside of said substantially cylindrical wall, said discharge port being formed in said substantially cylindrical wall.

12. The breather structure for a blow-by gas in an internal combustion engine according to claim 11, wherein said substantially cylindrical wall, said outlet, and said discharge port are formed in a cover forming said crank chamber.

13. The breather structure for a blow-by gas in an internal combustion engine according to claim 11, wherein said substantially cylindrical wall projects inwardly from said cover to provide a substantially circular passageway for blow-by gas to be collected therein for centrifugally separating oil from said blow-by gas.

14. The breather structure for a blow-by gas in an internal combustion engine according to claim 13, wherein oil separated from said blow-by gas is discharged through said discharge port.

15. The breather structure for a blow-by gas in an internal combustion engine according to claim 11, and further including a guide member disposed adjacent to said discharge port for aiding in the discharge of oil from said blow-by gas.

16. The breather structure for a blow-by gas in an internal combustion engine according to claim 11, wherein said outlet communicating with said breather passage is disposed at a point on an outer circumference of said substantially cylindrical wall at a point displaced relative to said discharge port.

17. The breather structure for a blow-by gas in an internal combustion engine according to claim 11, wherein said outlet communicating with said breather passage is in communication with a blow-by gas chamber for receiving blow-by gas with oil removed therefrom prior to discharging said blow-by gas to an air cleaner.

18. The breather structure for a blow-by gas in an internal combustion engine according to claim 11, wherein said substantially cylindrical wall surrounds an end portion of a crank shaft for forming an area for collecting the blow-by gas and subsequently applying a centrifugal force thereto for removing oil therefrom.

19. The breather structure for a blow-by gas in an internal combustion engine according to claim 11, wherein said rotor includes an outer rotor for producing a turning flow of the blow-by gas for permitting centrifugal separation of the oil contained therein.

20. The breather structure for a blow-by gas in an internal combustion engine according to claim 11, wherein oil centrifugally separated from said blow-by gas contacts an inner surface of said cylindrical wall and is transported in a clockwise direction by a turning flow generated by a clockwise rotation of a leading end portion of said crank shaft.

* * * * *